US005707428A

United States Patent [19]

Feldman et al.

[11] Patent Number: 5,707,428

[45] Date of Patent: Jan. 13, 1998

[54] LAMINAR FLOW ELECTROSTATIC PRECIPITATION SYSTEM

[75] Inventors: Paul L. Feldman, Sykesville, Md.; Krishnaswamy S. Kumar, Millford, N.J.

[73] Assignee: Environmental Elements Corp., Baltimore, Md.

[21] Appl. No.: 512,198

[22] Filed: Aug. 7, 1995

[51] Int. Cl.[6] ..... B03C 3/12

[52] U.S. Cl. ..... 96/54; 96/60; 96/79; 96/97

[58] Field of Search ..... 96/54, 77, 60, 96/78, 79, 97; 95/78, 79; 55/DIG. 25, DIG. 38, 360; 110/216, 345; 361/225, 226, 235

[56] References Cited

U.S. PATENT DOCUMENTS

| | | | |
|---|---|---|---|
| 977,335 | 11/1910 | Shaffner | 96/63 |
| 1,329,844 | 2/1920 | Meston | 95/72 |
| 1,381,660 | 6/1921 | Rathbun | 95/57 |
| 1,413,993 | 4/1922 | Rhodes | 95/61 |
| 1,427,370 | 8/1922 | Fortescue | 96/62 |
| 1,790,961 | 2/1931 | Welch | 96/60 |
| 1,944,523 | 1/1934 | Miller | 95/72 |
| 2,295,152 | 9/1942 | Bennett | 96/54 |
| 2,422,564 | 6/1947 | Pegg | 96/75 |
| 2,497,169 | 2/1950 | Herber et al. | 96/64 |
| 2,556,982 | 6/1951 | Roos et al. | 96/66 |
| 2,648,394 | 8/1953 | Allan | 96/73 |
| 2,711,225 | 6/1955 | Armstrong et al. | 96/62 |
| 2,844,214 | 7/1958 | Hall et al. | 96/66 |
| 3,073,094 | 1/1963 | Landgraf et al. | 96/66 |
| 3,495,379 | 2/1970 | Hall et al. | 95/79 |
| 3,555,818 | 1/1971 | Vlier | 96/64 |
| 3,562,127 | 2/1971 | Wooten et al. | 204/164 |
| 3,633,337 | 1/1972 | Walker et al. | 55/220 X |
| 3,668,836 | 6/1972 | Richardson et al. | 96/66 |
| 3,740,927 | 6/1973 | Vincent | 96/54 |
| 3,830,039 | 8/1974 | Ebert et al. | 55/430 X |
| 3,853,750 | 12/1974 | Volsy | 55/418 X |
| 3,973,932 | 8/1976 | Alskog | 55/481 X |
| 4,038,049 | 7/1977 | Melcher et al. | 96/60 X |
| 4,072,477 | 2/1978 | Hanson et al. | 55/DIG. 38 |
| 4,205,962 | 6/1980 | Marion et al. | 48/197 R |
| 4,822,381 | 4/1989 | Mosley et al. | 96/77 X |
| 4,908,047 | 3/1990 | Leonard | 60/275 X |
| 5,009,677 | 4/1991 | Wolf et al. | 95/76 |
| 5,084,077 | 1/1992 | Junker et al. | 96/77 X |
| 5,125,230 | 6/1992 | Leonard | 60/274 |
| 5,254,155 | 10/1993 | Mensi | 96/44 |
| 5,466,279 | 11/1995 | Hattori et al. | 96/77 X |

FOREIGN PATENT DOCUMENTS

| | | | |
|---|---|---|---|
| 9857 | 4/1980 | European Pat. Off. | 96/54 |
| 895756 | 11/1953 | Germany . | |
| 3324803 | 1/1985 | Germany . | |
| 1220195 | 12/1986 | U.S.S.R. . | |
| 913172 | 12/1962 | United Kingdom . | |

*Primary Examiner*—Richard L. Chiesa
*Attorney, Agent, or Firm*—Morton J. Rosenberg; David I. Klein

[57] ABSTRACT

An electrostatic precipitation system (100) utilizes laminar flow of a particulate-laden gas in order to enhance the removal of sub-micron sized particulates. The system incorporates a vertically oriented housing (105) through which the gas flows downwardly therethrough to a lower outlet port (110). The gas, which may be a flue gas enters the laminar flow precipitator (102) through an inlet port (108) for passage through a charging section (104). The charging section (104) imparts a charge to the particulates carried by the flue gas. The flue gas and charged particles then flow to a collecting section (106) which is downstream and below the charging section (104). The collecting section (106) is formed by a plurality of substantially parallel tubular members, each tubular member defining a collecting passage therein. Each tubular member (118) is electrically coupled to a potential that is of opposite polarity to that imparted to the particulates, so as to attract the charged particulates to an inner surface thereof. The collected particulates are subsequently collected in a hopper (112) or reentrained in the gas stream as agglomerates for subsequent removal from the gas by a secondary filter (120), the gas stream then being conveyed to a stack (14) wherein the particulate-free gas can be emitted into the atmosphere.

9 Claims, 5 Drawing Sheets

LAMINAR FLOW ELECTROSTATIC PRECIPITATION SYSTEM

BACKGROUND OF THE INVENTION

1. Field of the Invention

This invention directs itself to an electrostatic precipitation system wherein 100% particulate removal can practically be achieved. In particular, this invention directs itself to an electrostatic precipitation system having a laminar flow precipitator. To achieve laminar flow, the precipitator is divided into a charging section for imparting a charge to the particulates carried in a gas stream and a collecting section having an electrode disposed at a potential that is different from than of the charged particles, for attracting the charged particles thereto. More in particular, this invention pertains to a collecting section of a precipitator formed by a plurality of substantially parallel collecting passages, each passage being formed by a tubular member which is electrically coupled to the reference potential. Further, this invention directs itself to a laminar flow precipitator wherein the charging section and collecting section share a common reference potential electrode, wherein the charging portion thereof is provided with a corona discharge and the collecting portion thereof is devoid of corona discharge.

2. Prior Art

The governmental requirements for preventing the emission of hazardous air pollutants is continually being made more stringent. Most prominent of the air pollutants being restricted, are toxic trace metals and their compounds. These compounds primarily exist in the form of particulate matter. Due to the nature of particulate formation in combustion processes, many of the trace metals, such as arsenic, cadmium, nickel, etc., as well as the high-boiling point organic hazardous air pollutants tend to concentrate on the fine, sub-micron sized particulates present in a flue gas. The problem of control of toxic trace metals and heavy organic pollutants therefore becomes largely a problem of fine particulate control. Other governmental regulations with respect to air emissions require control of sub-micron sized particles, as well.

Conventional collectors, electrostatic precipitators and fabric filters, are very capable of fine particulate control, but as the government requirements exceed 99.9%, they have difficulty in delivering consistent reliable performance, especially for the respirable particles in the 0.2 to 0.5 micron range. As the government regulations become more stringent, adequate control of toxic emissions will require particulate collection efficiencies of 99.95% or greater.

Conventional industrial electrostatic precipitators collect dry particulates in a parallel plate, horizontal flow, negative-polarity, single-stage system design. Collecting plate spacing generally ranges from 9 to 16 inches, and plate height can be up to 50 feet. Flow through the precipitator is always well into the turbulent range. Due to the turbulent flow, precipitator collection efficiency is predicted utilizing the Deutsch model, which assumes that the turbulence causes complete mixing of the particles in the turbulent core of the flow gas, and electrical forces are operative only across the laminar boundary layer. This model leads to an exponential equation relating collection efficiency to the product of the electrical migration velocity of the particles and the specific collecting area of the precipitator. The exponential nature of the equation means that increasing of the specific collecting area yields diminishing returns in the efficiency at the high collection efficiency levels. Therefore, the 100% collection efficiency level is approached only asymptotically in the turbulent flow case and cannot in actuality be reached, no matter how large the precipitator.

It has long been known that laminar flow precipitation provides many advantages over turbulent flow. In laminar flow, the flow stream lines are parallel and in the direction of flow; there is no force causing particles near the collecting surface to be thrown back into the central flow region. Therefore, the electrical forces tending to move the particles toward the collecting surface are effective across the entire flow cross-section, not just across the laminar sublayer. As a result, the equation which relates collection efficiency to the product of the electrical migration velocity of the particles and the specific collecting area defines a linear relationship, whereby collection efficiency is possible.

Besides the practical achievement of 100% collection efficiency, equivalent efficiencies in a laminar flow system can be achieved with a significantly smaller specific collecting area. The striking difference between the collection efficiencies of laminar flow, versus turbulent flow can be seen utilizing a typical utility fly ash emission system, calculating the specific collecting area (in square feet per thousand acfm) versus collection efficiency in two cases. In a turbulent flow system a specific collecting area of 230 is determined to be required at 99% collection efficiency, and is calculated to be over 800 at 99.99%. In a laminar flow calculation, on the other hand, the specific collecting area requirement is determined to range from 100 at 99% efficiency to only 160 at 99.99%. Thus, a turbulent flow precipitator is more than twice the size of an equivalent laminar flow precipitator at 99% collection efficiency and at 99.99% efficiency the turbulent flow precipitator must be more than five times larger than an equivalent laminar flow system. Although the advantages of laminar flow precipitation have been known, prior attempts to incorporate those principles into a working system have been unsuccessful or impractical for industrial scale applications. A major obstacle to achieving laminar flow in such systems has been the turbulence introduced by the corona discharge of the precipitator itself. However, the instant invention utilizes a substantially vertically and downwardly directed gas flow in combination with a two stage electrostatic precipitator design having separate charging and collecting sections to achieve a practical laminar flow electrostatic precipitation system.

The best prior art known to the Applicants include U.S. Pat. Nos. 1,329,844; 1,413,993; 1,944,523; 2,497,169; 2,648,394; 2,711,225; 3,495,379; 3,633,337; 3,830,039; 3,853,750; 4,072,477; 4,908,047; 5,009,677; 5,125,230; and, 5,254,155.

In some prior art systems, such as that shown in U.S. Pat. No. 5,254,155, an electrostatic precipitator system is disclosed wherein a single-stage structure is provided. Such systems provide a plurality of passageways that are defined by a honeycomb structure for gas flow upwardly therethrough. Stationary rods extend into each passageway, the rods being coupled to the negative output of a power supply, while the walls of the honeycomb passageways are coupled to a reference potential. Removal of the collected particulates is accomplished by washing them downwardly utilizing a liquid mist (water) collected from the gas stream. The liquid mist is introduced into the gas flow upstream of the electrostatic precipitator electrodes, and is introduced solely for cleaning contaminants from the collecting electrodes. Since a corona discharge is maintained throughout the length of the honeycomb passages, laminar gas flow is not achieved.

In other systems, such as that disclosed by U.S. Pat. No. 2,648,394, the gas to be cleaned flows downwardly through a housing in order to be directed upwardly through the precipitator which is defined by a plurality of tubular members having centrally disposed electrodes extending axially therethrough. Here again, a single-stage system is provided wherein laminar flow of the gas is not achieved. Spray nozzles are also provided for introducing water droplets into the gas inlet conduits which serve to flush deposited material out of the tubular members.

In other systems, like those shown in U.S. Pat. Nos. 5,009,677 and 2,497,169, single-stage electrostatic precipitators are formed utilizing a plurality of vertically oriented tubular collecting electrodes through which a discharge electrode extends axially therethrough, for establishing a corona discharge throughout the length of the tubular electrode.

None of these prior art systems direct themselves to achieving laminar flow of the particulate-laden gas. Additionally, these prior art systems do not direct the gas downwardly through electrostatic tubular collecting electrodes which are devoid of corona discharge thereby resulting in a less efficient system than that provided by the instant invention.

SUMMARY OF THE INVENTION

An electrostatic precipitation system using laminar flow for removing sub-micron sized particulates entrained in a flue gas is provided. The electrostatic precipitation system includes a housing coupled in fluid communication with a flue. A power source is provided having a first output for supplying a reference potential and at least a second output for supplying a potential that is negative with respect to the reference potential. The electrostatic precipitation system includes an assembly for electrostatically charging particulates disposed within the housing and coupled in fluid communication with the flue having flue gas passing therethrough. The charging assembly is coupled to the first and second outputs of the power supply for imparting a charge that is negative with respect to the reference potential to the particulates carried by the flue gas. The electrostatic precipitation system further includes an assembly for collecting the charged particulates disposed within the housing and downstream of the charging assembly. The collecting assembly forms a laminar flow of the flue gas therethrough. The collecting assembly is coupled to the power source for establishing an electrostatic field to attract the charged particulates including sub-micron sized particulates.

DESCRIPTION OF THE PREFERRED EMBODIMENTS

Referring now to FIGS. 1–10, there is shown electrostatic precipitation system 100 for removing particulates, including fines, sub-micron sized particles, from an emission source. As will be seen in following paragraphs, electrostatic precipitation system 100 incorporates a laminar flow precipitator 102 capable of substantially 100% collection efficiency. The novel features of laminar flow precipitator 102 are suitable for incorporation in both wet and dry precipitation systems where high particulate removal efficiencies are required.

Figure 1:
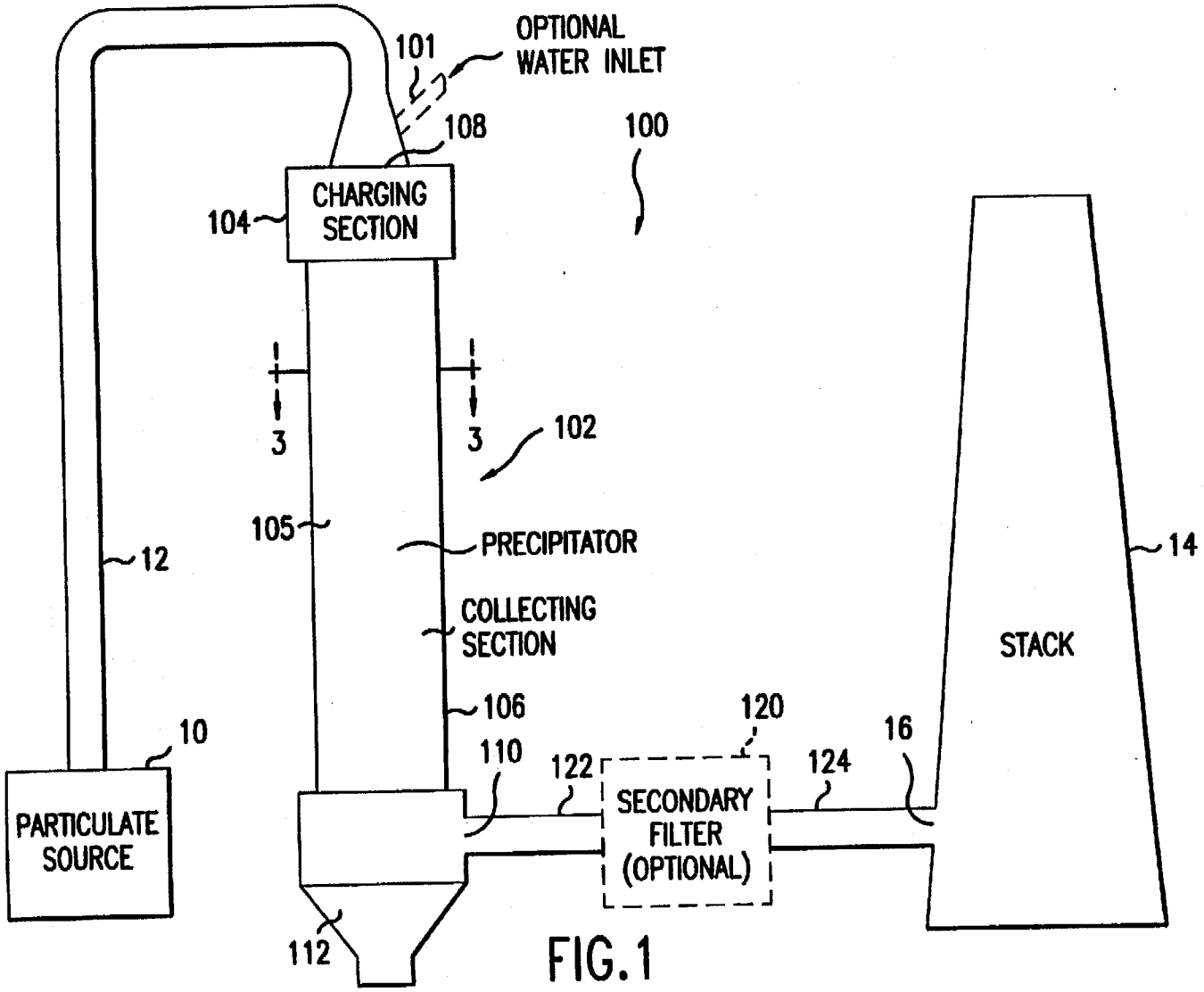
FIG. 1 is a system block diagram of one embodiment of the electrostatic precipitation system.

Referring to FIG. 1, there is shown, electrostatic precipitation system 100 coupled in-line between a source 10 of particulates entrained in a gas and a stack 14 for emission of the gas to the atmosphere. Although the source of particulates 10 may be any type of source, such sources include coal or oil fired furnaces or boilers, various types of incinerators, and any combustion process wherein hazardous air pollutants in the form of particulate matter are produced. As a coal fired furnace, for example, the source 10 has a flue pipe 12 which is coupled to the gas inlet 108 of the laminar flow precipitator's vertically oriented housing 105.

The particulates entrained in the flue gas entering the precipitator 102 through the inlet 108 must first be charged before they can be removed by electrostatic attraction, as such is the principal upon which all electrostatic precipitators operate. Such charging can be negative or positive, however, negative charging is more widely used. Precipitator 102 is specifically designed to create a laminar flow of flue gas in order to increase the efficiency of particulate removal. The particulates are charged as they pass through a corona discharge established between one or more pairs of parallel or concentric electrodes. The corona discharge which is necessary to efficiently impart the desired charge to the particulates to be removed, creates a "corona wind" which produces a turbulent flow in the gas pattern passing through the precipitator. Therefore, precipitator 102 is designed to separate the charging zone of the precipitator from the collection zone or agglomeration zone, the collection or agglomeration zone being enhanced by laminar flow of the gas flowing therethrough.

As shown in FIG. 1, the precipitator 102 is provided with a charging section 104 disposed upstream of the collecting section 106, wherein the flue gas entering the inlet 108 passes through charging section 104 and collection section 106 to then pass through the gas outlet 110. Particulates removed in collecting section 106 are subsequently dispensed to the particulate removal hopper 112, from which the waste materials are collected and disposed of. The particulates collected in collecting section 106 are dispensed to the hopper 112 by methods well known in the art. The collecting section may incorporate rappers to mechanically dislodge the collected particulates and cause them to drop into the hopper, or a wet precipitation method may be employed wherein water is supplied through a water inlet 101 to flow down through the collecting section 106 into hopper 112 and carry the collected particulates therewith.

The water inlet may be located upstream of the charging section, or alternately at the upstream end of the collecting section.

Alternately, collecting section 106 may only temporarily collect particulates, serving as a agglomerator for system 100. Particulates are attracted to the electrode surfaces and as the particulates come in contact with one another they agglomerate. The agglomerates then become reentrained into the gas stream for subsequent removal by a downstream precipitator or filter 120. This process is likewise enhanced by laminar flow of the flue gas therethrough.

As will be described in following paragraphs, the downward flow of gas reduces the reentrainment of the collected particles, where such is not desired. In the downward flow system gravity and the gas flow provide an aid to delivering particulates which come loose from the collecting electrodes, to the hopper 112. Such would not be the case where the gas directed upwardly or horizontally through the collection passages.

Where very high collector efficiencies are required, between 99.9% and 100%, and the precipitator is operated dry, reentrainment of particulates may be a design goal of the system, making the collector into an agglomerator. For such a system, the collecting section extends a sufficient distance beyond the charging section to permit collected particles to be reentrained into the gas stream. The collected particles, however, will agglomerate before being reentrained. If necessary, the gas can be conditioned with one of several known agglomeration promoters to ensure adequate agglomeration to form particulates of sufficient size to be easily removed. These now larger particles will flow with the gas stream through the outlet 110 into a conduit 122 for transport to a secondary filter 120 for removal of these larger particles. The secondary filter 120 may be a conventional electrostatic precipitator, a fabric filter such as a bag house-type filter, or other type of particulate removal device. The gas flowing from the secondary filter 120 will flow through a conduit 124 to the inlet 16 of the stack 14 to be emitted into the atmosphere free of particulates. In a system not specifically designed to reentrain particulates, filter 120 may be optionally provided to remove any agglomerated particulates which inadvertently become reentrained in the gas stream.

The laminar flow through collecting section 106 of system 100 is achieved by passing the gas through a plurality of substantially parallel collecting tubes having a predetermined diameter and at a predetermined velocity, downstream of the charging section 104 to achieve a Reynolds number less than 2,000. The well established Reynolds number is a dimensionless factor represented by the equation:

$$Re = \frac{DV}{\nu}$$

where:

D is the diameter of the tubes,

V is the mean velocity, v is the kinematic viscosity of the fluid.

The laminar flow, RE<2,000 must be satisfied. Thus, knowing the mean velocity of the gas and its viscosity, a tube diameter can be selected to satisfy the aforesaid relationship.

Figure 3:
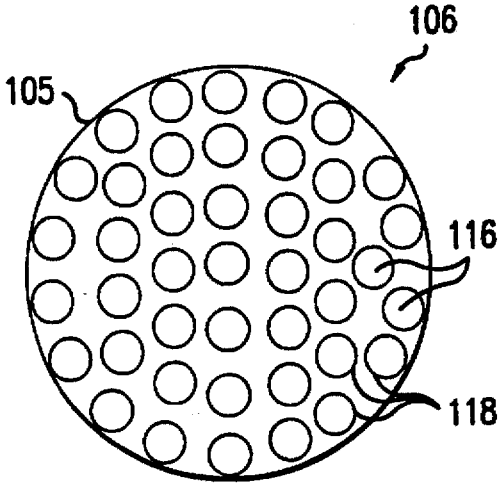
FIG. 3 is a sectional view of the collecting section portion of the electrostatic precipitation system taken along the section line 3—3 of FIG. 1.
Figure 4:
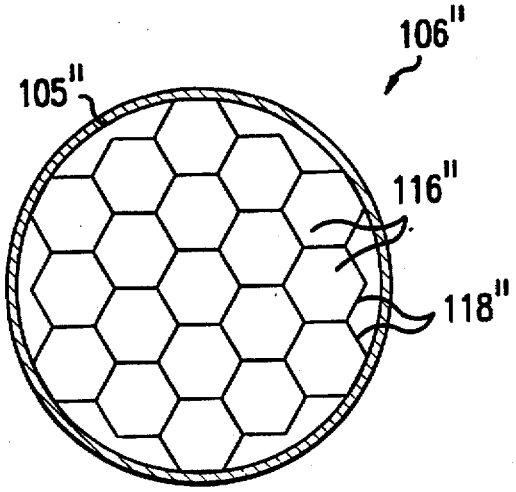
FIG. 4 is a sectional view of an alternate embodiment of the collecting section shown in FIG. 3.

As shown in FIG. 3, the collecting section 106 is formed by a plurality of collecting passages 106, the collecting passages being formed by respective tubular collecting members 118. In this particular embodiment, each of the tubular members 118 has a circular cross-sectional contour, but other shapes may be utilized and still obtain laminar flow. As shown in the alternate embodiment of FIG. 4, the collecting section 106" includes a plurality of collecting passages 116" disposed within the vertical housing 105". Each of the collecting spaces 116" are formed by a polygonal tubular collecting member 118". In particular, the honeycomb-like structure of collecting section 106" is formed by a plurality of hexagonal tubular members.

Figure 2:
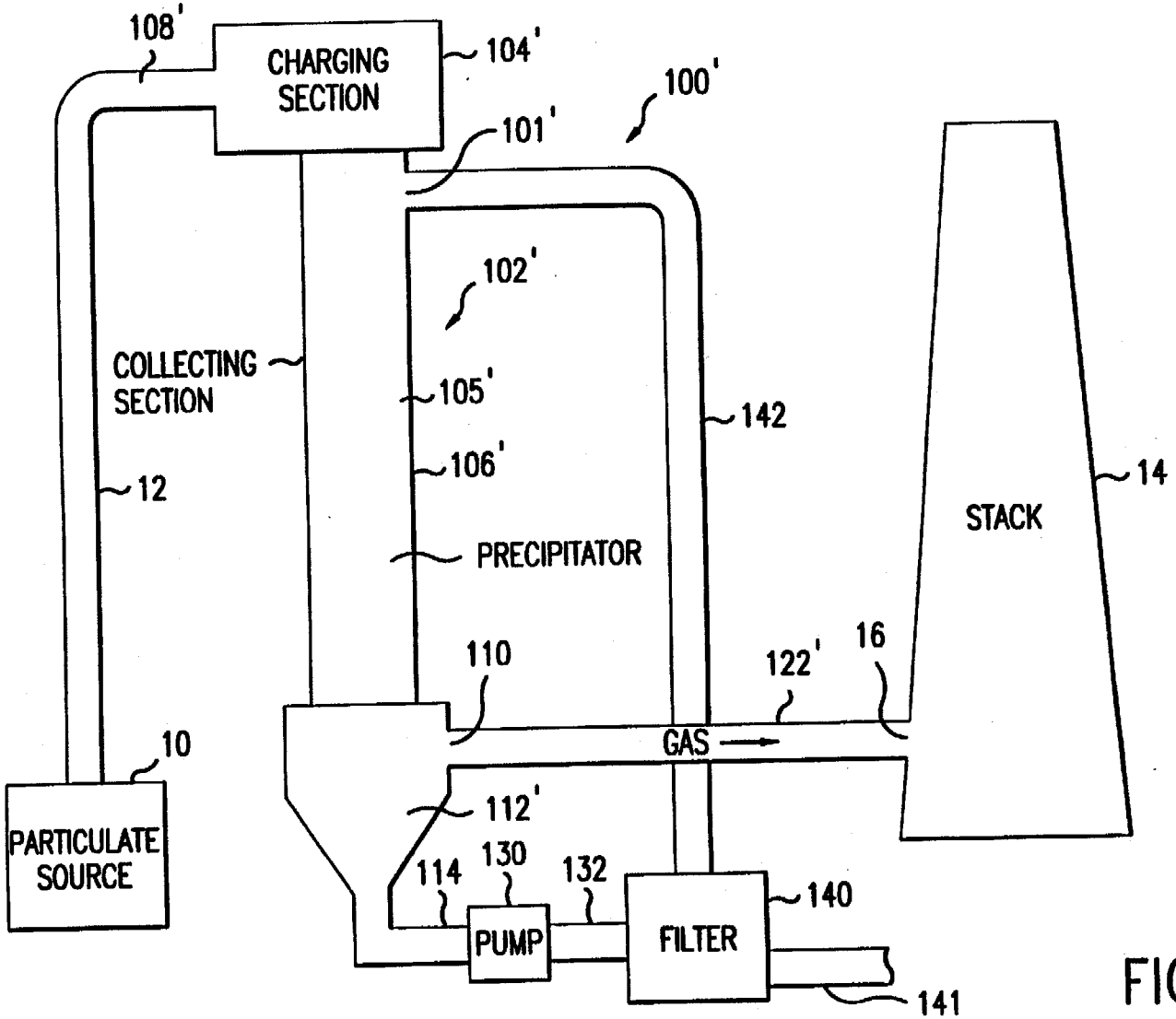
FIG. 2 is a system block diagram of a second embodiment of the electrostatic precipitation system.

Referring now to FIG. 2, there is shown, the electrostatic precipitation system 100'. As in the first embodiment, the outlet of a particulate source 10, such as a coal-fired furnace, is coupled to a flue 12 which brings the flue gas and entrained particulates to the precipitator inlet 108'. The flue gas and entrained particulates flow through a charging section 104' before flowing downwardly through a vertically oriented housing portion 105' of the laminar flow precipitator 102'. The vertically oriented housing 105' encloses the collecting section 106' for removing the particulates entrained in the flue gas. The particulate-free gas flows from an outlet 110 through a conduit 122' to the inlet 16 of the stack 14 for passage therethrough into the environment. The collecting section 106' includes a plurality of parallel passageways, as in the embodiment of FIG. 1, and connection of an optional system for circulating fluid through the collecting section for carrying off the particulates removed from the gas stream. A fluid such as water enters the vertical portion 105' of precipitator 102' through an inlet 101', and directed to flow through the plurality of parallel collecting passages contained therein, like those shown in FIG. 3 or FIG. 4. The particulate-laden water is collected in the hopper 112' and flows to a pump 130 through a conduit 114. Pump 130 displaces the water through a conduit 132 to a filter 140, wherein the particulates are removed from the water and clean water may then be recirculated to flow through a conduit 142 back to the inlet 101' or alternately out as waste through a conduit 141. Where the filtered water is passed through the waste conduit 141, and not recirculated, the conduit 142 will be coupled to a fresh water source to continually supply water to the inlet 101'. As in the embodiment of FIG. 1, precipitator 102' can be a dry system. As a dry system, precipitator 102' differs from precipitator 102 only in the orientation of the charging section 104', such having a horizontal flow therethrough.

The laminar flow precipitator 102, 102' is a two stage structure wherein the charging section 104, 104' may be oriented for downward vertical flow, as shown in FIG. 1, or oriented for horizontal flow as shown in FIG. 2. However, the collecting section 106, 106' is provided in a vertically oriented housing 105, 105' wherein the gas is directed to flow downwardly through a plurality of substantially parallel collecting passages. Both the charging section 104, 104' and the collecting section 106, 106' may be formed in any of several different arrangements, however, it is important that the collecting section not be subject to corona discharge, as such would create turbulence and inhibit achieving laminar flow therethrough.

Figure 5:
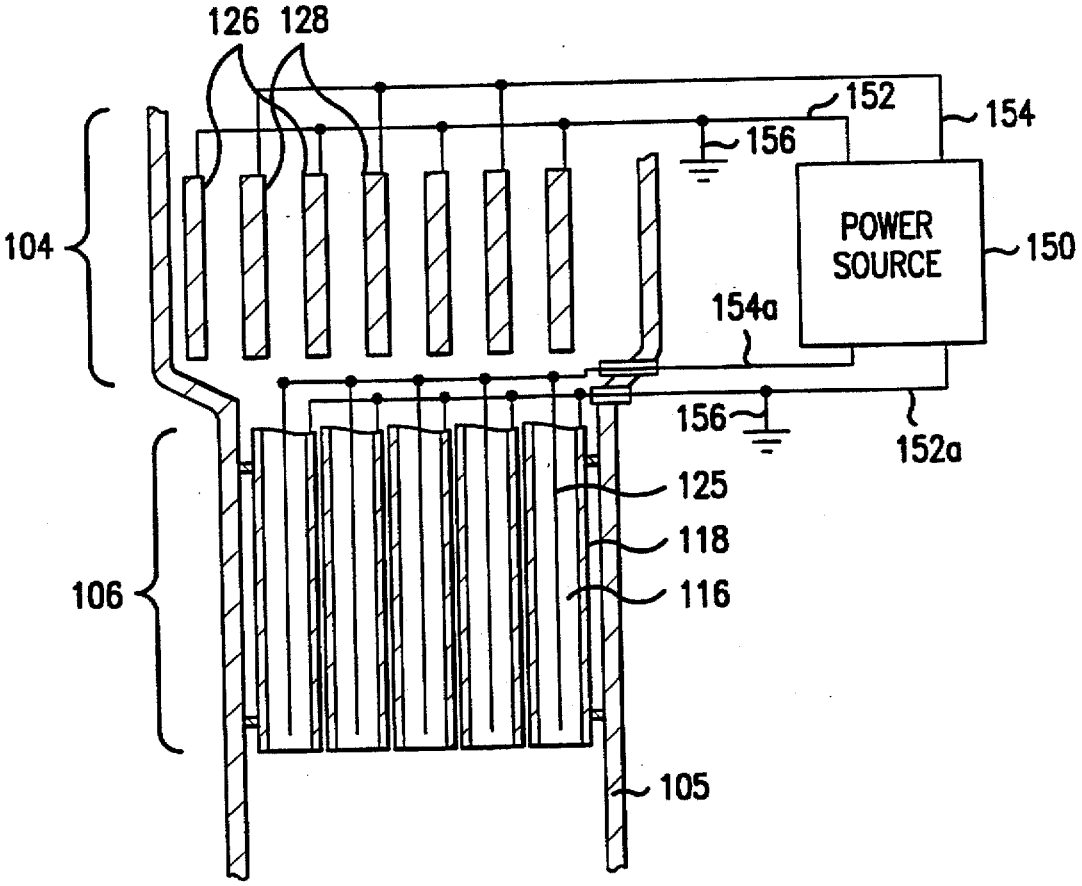
FIG. 5 is a cross-sectional elevation view of the charging and collecting sections showing the electrical connection thereof.

As shown in FIG. 5, the charging section 104 may be formed by a plurality of parallel electrodes 126, 128 which are respectively coupled to the reference voltage output line 152 and negative voltage output line 154 of the high voltage power source 150. Power source 150 may represent multiple power supplies, with different power supplies being coupled to different sections of the precipitator 102, 102'. The reference voltage output line 152 is coupled to the ground reference terminal 156 so that the high voltage potential supplied on line 154 is more negative than the ground reference level, to impart the appropriate negative charge on particulates passing between the respective electrodes 126, 128. As will be discussed in following paragraphs, other configurations of the charging section 104 may be utilized in the laminar flow precipitator 102, 102'. As previously discussed, the collecting section 106 is formed by a plurality of small tubular collecting members 118, each having a diameter or width dimension in the range of 1 to 3 inches and preferably in the range of 1.5 to 2.0 inches. Each tubular member 118 defines a respective collecting passage 116 through which the gas and charged particles pass. Each of the tubular members 118 is formed of a conductive material, and electrically connected to the reference voltage output line 152*a* of power source 150, which is referenced to ground potential by connection to ground terminal 156. As the conductive collecting tubes are coupled to the reference potential, and the charged particulates are charged more negatively, the particles are attracted to the inner wall surfaces of the tubes 118. A non-discharging electrode 125 extends concentrically within each collecting passage 116. Each electrode 125 may have a cylindrical configuration of predetermined diameter, and each is electrically coupled to the voltage output line 154*a*. Electrode 125 may be in the form of a wire-like electrode or other rod-like member, devoid of sharp corners or edges which could result in high electric field concentrations. The diameter of electrode 125 and the voltage applied thereto is selected to maximize an electric field within each space 116 without creating sparking or corona discharge. This is particularly important where collecting section 106 is used as an agglomerator. Laminar flow through section 106 is achieved for gas velocities in the range of 2.0 to 7.0 feet/second.

Figures 6, 7, 8:
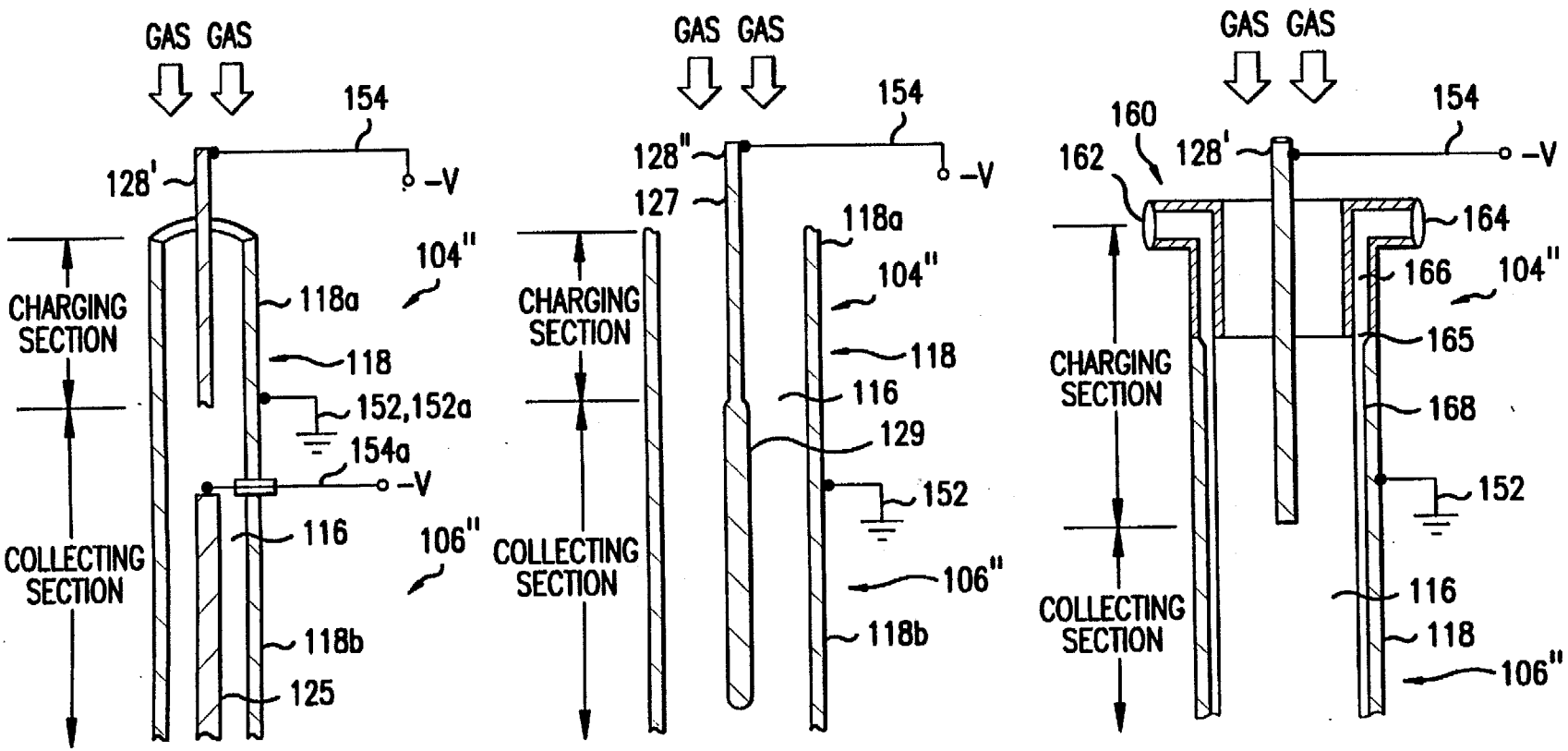
FIG. 6 is a cross-sectional elevation view of an integrated charging and collecting section.
FIG. 7 is a cross-sectional elevation view of another embodiment of an integrated charging and collecting section of the present invention.
FIG. 8 is a cross-sectional elevation view of yet another embodiment of an integrated charging and collecting section of the present invention.

Referring now to FIG. 6, there is shown an alternate configuration for the two stage laminar flow precipitator. FIG. 6 shows an electrode configuration of one of the plurality of collection passages wherein the charging section 104" is integrated with the collecting section 106" to have one electrode 118 in common therebetween. A cylindrically-shaped electrode 128' is electrically coupled to the negative voltage output 154 of the power supply. The electrode 128' extends a predetermined distance into the collection passage 116, the electrode being centrally located within the passage 116 in concentric relationship with the tubular member 118. The tubular member 118 is electrically coupled to the power supply output line 152. The distance that the electrode 128' extends into the tubular member 118 defines the charging section 104". The voltage applied between the electrodes 118 and 128', the spacing therebetween, and the diameter of electrode 128' being selected to establish a corona discharge between electrode 128' and a portion of the tubular member 118*a* for charging the particulates being carried by the flowing gas.

The remainder 118*b* of the tubular member 118 defines the collection section 106", the charged particles being attracted to the inner surface of the lower portion 118*b* of tubular member 118. An electrode 125 is concentrically disposed within the passage 116 and electrically coupled to the high voltage output line 154*a*. Electrode 125 has a cylindrical contour and provides a strong electrostatic field to act on the charged particulates passing through passage 116, without inducing corona discharge.

Another configuration for an integrated two stage laminar flow precipitator is shown in FIG. 7 represented by one of the plurality of collection passages. In this embodiment the electrode 128" is coupled to the negative voltage output line 154 and extends concentrically within the passage 116 defined by the tubular member 118. The upper portion 127 of electrode 128" is of a smaller diameter than the lower portion 129, and thereby concentrates the electric field lines directed to the reference electrode portion 118*a* of the charging section 104". The upper portion 127 of electrode 128" is dimensioned so as to induce corona discharge between the tubular electrode portion 118*a* and the electrode portion 127 at the applied voltage level. In order to increase the electric field between the charged particles and the collection electrode portion 118*b*, the negative electrode 128" is designed to extend a predetermined distance into the collection section 106". However, as previously discussed, corona discharge creates turbulence which would inhibit laminar flow through the collection section. Thus, the lower portion 129 of electrode 128" is dimensioned differently than that of the upper portion 127, such being dimensioned to increase the surface area of the portion 129 to reduce the concentration of electric field lines, as compared to upper portion 127, to thereby prevent the occurrence of corona discharge. Thus, the combination of electrode portion 129 and tubular member portion 118*b* provide an electrostatic field for increasing the electric field between the charged particles and the inner surface of the tubular member portion 118*b*, without the generation of corona discharge. In this configuration, the tubular member 118 is electrically coupled to the reference voltage output line 152 (ground) to provide a reference electrode 118*a* for the charging section and a collection electrode 118*b* for the collection section of the laminar flow precipitator.

Referring now to FIG. 8, there is shown, one of the laminar flow precipitator flow passages 116 having the charging section 104" integrated with the collection section 106" utilizing a common reference electrode 118. As was described for the embodiment of FIG. 6, the tubular member 118 is electrically coupled to the reference voltage output line 152 and the centrally disposed negative electrode 128' is electrically coupled to the negative voltage output line 154. In the embodiment shown in FIG. 8, however, the reference electrode further comprises a conductive fluid layer 168 which overlays the inner surface of the tubular member 118. Thus, the upper end of each tubular member 118 of the collecting section 106, 106' of the embodiments of FIGS. 1 and 2, are provided with a fluid distributing manifold 160 for dispensing a conductive fluid to the inner surface of the tubular members 118. Although any conducting fluid may be utilized, including fluidized particulates such as a metallic powder, the most economical fluid for such application is water. The manifold 160 shown is exemplary only and many other means may be employed for distributing the fluid to the inner surfaces of the tubular members, without departing from the inventive concept disclosed herein. The water passes into an inlet 162 and flows about an annular passage 166 to flow down through an annular orifice 165, as well as through an outlet 164 for passage to other of the manifolds 160. The water flowing from orifice 165 flows over the inner surface of the tubular member 118. The water that flows down the inner surface of each tubular member forms a conductive film 168 having the potential of the reference voltage, and thereby attracts the charged particulates thereto, as both flow through the collection section 106". The water film 168 serves two functions: (1) the water serves to carry off the attracted particulates and prevent their reentrainment into the gas stream, and (2) acts as a moving electrode, thereby aiding in the formation of a laminar flow of the gas stream. By directing both the gas and water film 168 downwardly, both can be displaced at substantially the same rate, approximately five feet per second, providing a net relative movement therebetween of zero. As the gas and electrode have no relative movement therebetween, drag is eliminated and laminar flow is thereby achieved.

Thus, by providing a precipitator having a collecting section 106, 106', 106" disposed within a vertically oriented housing 105, 105' for flow of a particulate-laden gas downwardly therethrough, with the gas flow being directed at a predetermined rate through a plurality of collecting passages 116, 116" devoid of corona discharge, a laminar flow of the gas is achieved. With the collecting passages being formed by a plurality of tubular members 118, 118" which are electrically coupled to a reference voltage output line 152 of a power supply 150, charged particulates entrained in the gas will be attracted thereto and removed from the downwardly flowing gas. Since corona discharge creates a turbulence which would prevent laminar flow, the particulates entrained in the gas are charged in a separate charging section 104, 104', 104" disposed upstream of the collecting section. The charging section may take the form of spaced parallel plates, or may be integrated into an upper portion 118*a* of the respective tubular members 118, 118". By this structure, a practical laminar flow precipitator system can be realized, and thereby 100% particulate removal can be achieved.

Figure 9:
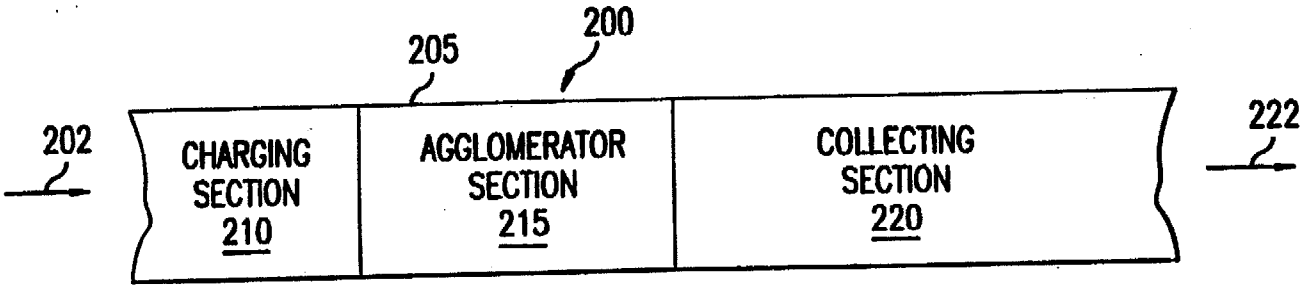
FIG. 9 is a system block diagram of another embodiment of the present invention; and, FIG. 10 is a cross-sectional view of a portion of the embodiment shown in FIG. 9.

Referring now to FIG. 9, there is shown, a system block diagram of another embodiment of the instant invention. The laminar flow electrostatic particulate removal system 200 is provided within a horizontally disposed housing or ductwork 205, wherein a particulate laden gas enters through one end, in a direction indicated by directional arrow 202, and flows horizontally therethrough to exit through the opposing end, as a clean gas, in a direction indicated by directional arrow 222. The electrostatic system 200 includes a charging section 210 designed to produce corona discharge therein and charge the particulates entrained in the gas stream. Subsequent to flowing through charging section 210, the gas and charged particulates pass through an agglomerator section 215, having a plurality of closely spaced passages with no corona discharge in which the gas achieves laminar flow, or near-laminar flow therethrough. The charged particulates are attracted to wall surfaces in agglomerator 215, and collect thereon, agglomerate with other particles, and become re-entrained as larger agglomerated particulates to be subsequently removed by the collecting section 220. Collecting section 220 may constitute a collection structure such as that previously described, or be formed by a conventional electrostatic precipitator, or fabric type filter. The collecting section may be closely spaced to agglomerator section 215, as shown, or disposed more remotely.

System 200 may be retrofit into an existing conventional electrostatic precipitator, wherein at least a portion of the original precipitator forms the charging section 210 of system 200. The agglomerator section 215 of system 200 provides temporary collection of particulates and may closely resemble the structure of the charging section 210, however, the alternating electrodes will be much more closely spaced and will be devoid of any discharge electrodes or other bodies between adjacent electrodes. Conventional electrostatic parallel plate precipitators have an electrode spacing which ranges from 9–16", with such electrode plates having a height which can range up to 50' The agglomerator 215 may be similarly constructed from flat parallel plates which are closely spaced, the electrode spacing being less than 4" and preferably on the order of approximately 2". Each of the charging and agglomerator sections should have a sufficient longitudinal dimension such that the gas residence time ranges from 0.5 to 2.0 seconds, with a preferred residence time approximating 1.0 second.

Figure 10:
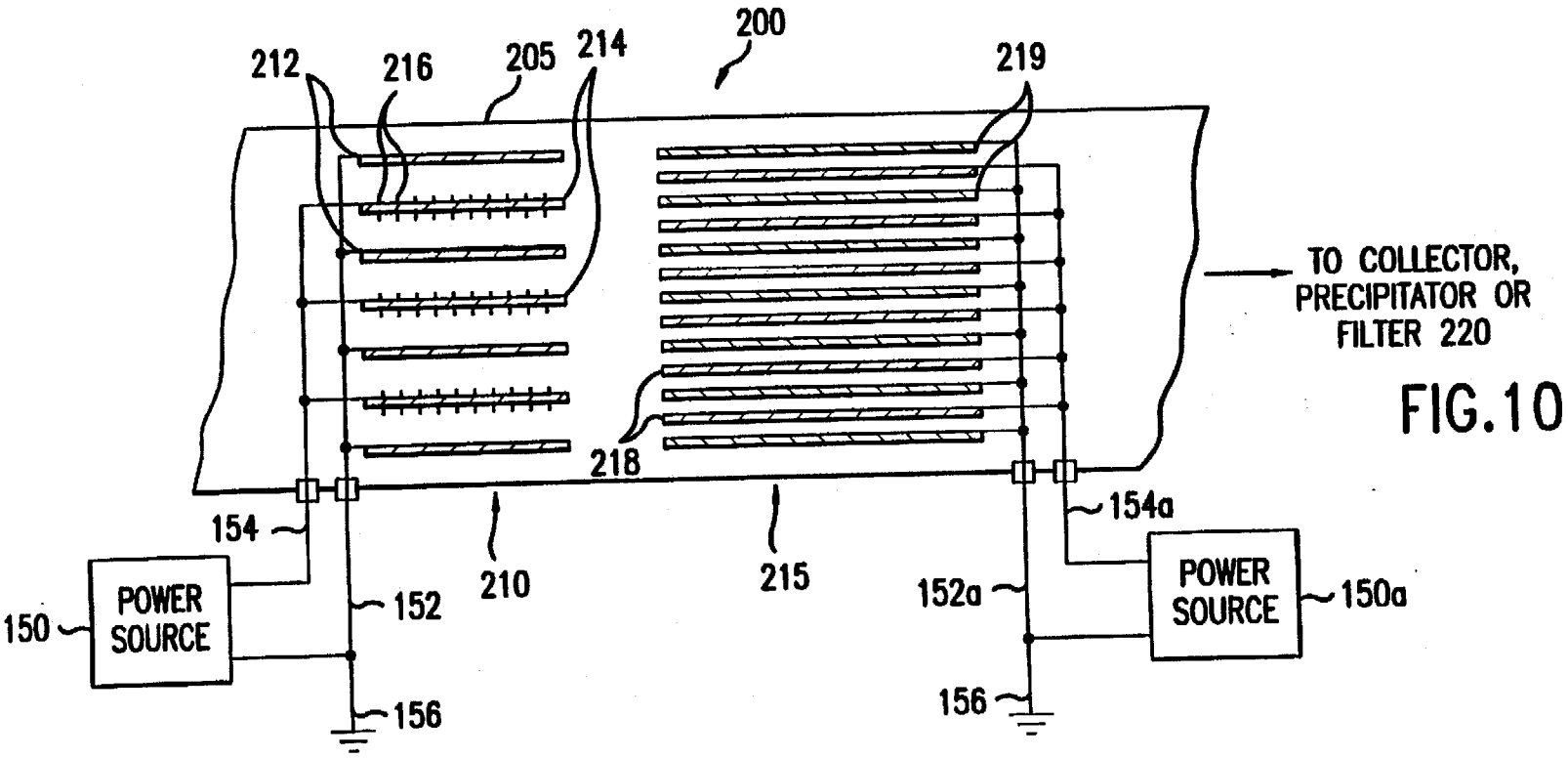

Turning now to FIG. 10, the structure of the charging and agglomerator sections can be more clearly seen. Charging section 210, disposed within the horizontally disposed ductwork 205, is formed by a plurality of alternating electrodes 212 and 214 which are coupled to opposing output lines of a power supply 150. The electrodes 212 are electrically coupled to the power supply output line 152, which is coupled to the ground reference 156. The high voltage output line 154 may supply a negative DC high voltage, a negative pulsating voltage, or combination thereof. The magnitude of the voltage between the output voltage lines 154 and 152 is sufficiently high to induce a corona discharge between the electrodes 214 and 212, without shorting thereacross. Each of the electrodes 214 may include a plurality of corona discharge electrode points 216 coupled thereto to promote the generation of corona discharge in the charging section 210. Agglomerator section 215 includes a plurality of electrodes 218 and 219 coupled to respective power supply output lines 152*a* and 154*a* of the power supply 150*a*. Each of the electrode plates 218, 219 are closely spaced, as previously discussed, and devoid of any corona inducing type structures. The power supply 150*a* operates at a different voltage than that of power supply 150, supplying sufficient voltage to attract and agglomerate particulates carried in the gas stream, without producing any corona discharge. The output line 154*a* of power supply 150*a* is referenced to the output line 152*a* which is coupled to the ground reference 156 and therefore coupled in common with the output line 152 of power supply 150. The gas passing through agglomerator 215 with its re-entrained agglomerates then flows to the collector section 220, which may be a separate and distinct precipitator or filter. By the arrangement shown in FIG. 10, system 200 can be retrofit into a process employing a conventional horizontal flow parallel plate electrostatic precipitator, and result in a system which benefits from laminar flow of the Gas through the agglomerator 215, or both the agglomerator 215 and the collector 220.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An electrostatic precipitation system utilizing laminar flow for removing sub-micron sized particulates entrained in a flue gas, comprising:

a housing coupled in fluid communication with a flue;

a first power source having a first output and a second output for supplying a predetermined first potential difference therebetween;

means for electrostatically charging particulates disposed within said housing and coupled in fluid communication with the flue for flow of the flue gas therethrough, said charged particulates including sub-micron sized particulates, said charging means being coupled to said first and second outputs of said first power source for imparting a charge of a predetermined polarity to the particulates carried by the flue gas;

a second power source having a first output and a second output for supplying a predetermined second potential difference therebetween, said predetermined second potential difference being less than said predetermined first potential difference;

an agglomerator disposed down stream of said charging means for flow of flue gas therethrough, said agglomerator including a plurality of longitudinally extended plate electrodes disposed in substantially parallel spaced relation, said plurality of plate electrodes being of sufficient number and sufficiently spaced for forming a substantially laminar flow of said flue gas therethrough said plurality of plate electrodes being respectively coupled to said first and second outputs of said second power source in an alternating sequence to couple opposing polarities of said predetermined second potential to adjacent plate electrodes, said predetermined second potential being of sufficient magnitude to attract and agglomerate the particulates but insufficient to prevent agglomerated particulates from being re-entrained into said laminar flow of the flue gas; and, means for collecting said agglomerated particulates disposed downstream of said agglomerator.

2. The electrostatic precipitation system as recited in claim 1 where said power source includes a third output coupled in common with said first output thereof and a fourth output.

3. The electrostatic precipitation system as recited in claim 2 where said collecting means is formed by a plurality of substantially parallel plate electrodes, a first portion of said plurality of plate electrodes being electrically coupled to said third output of said power source and a second portion of said plurality of plate electrodes being electrically coupled to said fourth output of said power source, said second portion of said plurality of plate electrodes being interposed between alternate ones of said first portion of said plurality of plate electrodes.

4. The electrostatic precipitation system as recited in claim 1 where said collecting means is adapted for laminar flow of the flue gas therethrough.

5. An electrostatic system for removing sub-micron sized particulates entrained in a flue gas, comprising:

means coupled to a flue for electrostatically charging particulates entrained in a flue gas, said charged particulates including sub-micron sized particulates;

an agglomerator coupled in fluid communication with said charging means and down stream thereof for flow of the flue gas therethrough, said agglomerator including a plurality of longitudinally extended plate electrodes disposed in substantially parallel spaced relation, each of said plurality of plate electrodes being devoid of corona inducing type structures, said plurality of plate electrodes being of sufficient number and sufficiently spaced for forming a substantially laminar flow of said flue gas therethrough, adjacent ones of said plurality of plate electrodes being respectively coupled to opposing polarities of a D.C. potential, said D.C. potential being of sufficient magnitude to attract and agglomerate the particulates but insufficient to prevent agglomerated particulates from being re-entrained into said laminar flow of the flue gas; and, means for collecting said agglomerated particulates coupled in fluid communication with said agglomerator and downstream thereof.

6. The electrostatic system as recited in claim 5 where said agglomerator is dimensioned to provide a flue gas residence time within the range of 0.5 to 2.0 seconds.

7. The electrostatic system as recited in claim 6 where said plurality of longitudinally extended plate electrodes of said agglomerator have a spacing of less than 4.0 inches.

8. The electrostatic system as recited in claim 6 where said plurality of longitudinally extended plate electrodes of said agglomerator have a spacing approximating 2.0 inches.

9. The electrostatic system as recited in claim 5 where said collecting means is adapted for laminar flow of the flue gas therethrough.

* * * * *